US006056467A

United States Patent [19]

De Laforcade

[11] Patent Number: 6,056,467

[45] **Date of Patent: *May 2, 2000**

[54] ASSEMBLY FOR DISPENSING A LIQUID PRODUCT THROUGH A PRODUCT DISPENSING MEMBER

[75] Inventor: Vincent De Laforcade, Rambouillet, France

[73] Assignee: L'oreal, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/692,766

[22] Filed: Aug. 6, 1996

[30] Foreign Application Priority Data

Aug. 8, 1995 [FR] France ..... 95 09620

[51] Int. Cl.[7] ..... A46B 5/02

[52] U.S. Cl. ..... 401/190; 401/15

[58] Field of Search ..... 401/190, 13, 15; 132/290

[56] References Cited

U.S. PATENT DOCUMENTS

| | | | |
|---|---|---|---|
| 1,112,815 | 10/1914 | Lynam | 401/15 |
| 1,300,651 | 4/1919 | Robbins | 401/269 |
| 1,811,965 | 6/1931 | Priest | 132/290 |
| 2,140,009 | 12/1938 | Hand | 401/202 |
| 2,317,111 | 4/1943 | Perwas | 401/269 X |
| 3,256,549 | 6/1966 | Evesque | 401/190 |
| 4,341,348 | 7/1982 | Pearling | 401/190 X |
| 4,480,940 | 11/1984 | Woodruff | 401/202 X |
| 4,726,700 | 2/1988 | Gray | 401/15 |

FOREIGN PATENT DOCUMENTS

| | | | |
|---|---|---|---|
| 455552 | 11/1991 | European Pat. Off. | 401/190 |
| 2713060 | 11/1993 | France . | |
| 8800797 | 10/1989 | Netherlands . | |

*Primary Examiner*—David J. Walczak
*Attorney, Agent, or Firm*—Oblon, Spivak, McClelland, Maier & Neustadt, P.C.

[57] ABSTRACT

The invention relates to an assembly for dispensing a product which comprises a container containing a product to be dispensed, a product dispensing member in communication with the container, and a cover which is equipped with a cap that covers the application member and which is fastened to the container. The cover comprises at least two orifices which are capable of generating a circulation of air in an internal volume of the cover. A collar is fitted on the container and ensures that the cap is held on the container, and at least one orifice of the cover is arranged in the collar.

10 Claims, 1 Drawing Sheet

ASSEMBLY FOR DISPENSING A LIQUID PRODUCT THROUGH A PRODUCT DISPENSING MEMBER

BACKGROUND OF THE INVENTION

Field of the Invention

The invention relates to an assembly for dispensing a fluid. The dispensing assembly can be used in, for example, the fields of (i) cosmetics for the application of a deodorant and (ii) pharmaceuticals for the application of insect repellents, and in the fields of adhesives, paints or wax polishes. Thus, the dispensing assembly of the present invention can be used for the application of a body deodorant.

DISCUSSION OF THE BACKGROUND

FR-A-2,713,060, describes a dispensing assembly comprising a container of liquid under pressure, equipped with a dispensing valve and with an application member comprising a porous dome fastened on the container. This dome is held by a support connected mechanically to a collar fastened to the container. When this assembly is applied to the surface to be treated, the porous dome becomes impregnated with liquid. At the end of application, an excess amount of product may remain in the dome and flow off along the container accumulating between the collar and the container. Thus, during subsequent use, the accumulated product flows off onto the surface to be treated, especially when the assembly in tilted. Moreover, this excess amount of product will flow along the wall of the container at the risk of splashing the user. Furthermore, the container will become dirty where it is gripped.

This disadvantage also occurs in dispensing assemblies comprising a push-button equipped with a spray nozzle. To overcome these disadvantages, various solutions have been considered. The first involved reducing the delivery of the valve. However, this reduction delayed the emergence of the product and did not prevent the product from running out. The second entailed increasing the rigidity of the spring of the valve in order to avoid a prolonged actuation of the valve. The user would then have a feeling of discomfort attributable to the difficulty in applying the assembly to the surface to be treated. The third solution involved increasing the retention volume of the porous dome. However, the phenomenon of product running out would only be delayed, without being reduced in quantity.

NL-A-8 800 797 discloses a cap for a sprayer, the cap comprising a lateral wall equipped on its lower part with two orifices provided with safety tabs, making it possible to remove the cap from the container by means of a screwdriver. However, these orifices made in the lower part of the lateral wall of the cap weaken the hold of the cap on the reservoir from which it can then easily become disconnected. Moreover, a cap equipped with two orifices located at the same level in the lateral wall is complicated to produce and is costly. Furthermore, this document does not teach a circulation of air between these two orifices.

SUMMARY OF THE INVENTION

The present invention therefore aims to overcome the above-mentioned disadvantages.

An object of the present invention is to provide for a dispensing assembly, as defined above, which avoids the accumulation of product between the cap and the container, the accumulation risking soiling the walls of the container, while at the same time ensuring that the cap is held securely on the reservoir.

It has been discovered in an unexpected way that such a result could be obtained by arranging on the reservoir a collar provided with at least one orifice.

The present invention therefore provides for an assembly for dispensing a product, comprising a container containing a product to be dispensed and having an axis of symmetry (X), a product-dispensing member in communication with the container, and a cover which is equipped with a cap covering the dispensing member and which in fastened to the container. The cover comprises at least two orifices, characterized in that the cover comprises a collar fitted on the container and ensuring that the cap is held on the container, at least one of the orifices of the cover is arranged in the collar, and the two orifices are designed to generate a circulation of air in the internal volume of the cover.

Advantageously, at least two orifices are arranged at different heights according to an axis of symmetry (X) of the dispensing assembly, so as to ensure good circulation of the air within the cover.

Preferably, at least one orifice is arranged in a wall of the cap. Thus, the cover comprises at least two orifices arranged at different heights along the axis (X).

In one embodiment of the invention, the wall of the cap can comprise an upper surface and a lateral surface. Each of these surfaces of the cap can comprise at least one orifice. These alternatives make it possible to use the hole, often present on the cap, in order to discharge the air trapped when the user replaces the cap on the container.

In another preferred embodiment of the invention, the dispensing assembly can comprise at least one orifice in the collar and at least one orifice in the cap, preferably in the upper surface of the cap. This arrangement is conducive to good air circulation.

Moreover, the dispensing assembly can comprise connection means between the dispensing member and the collar, thus enabling the user to handle the assembly easily and imparting operating flexibility. The connection means include of a plurality of flexible tabs distributed uniformly between the application member and the collar.

In order to ensure circulation of the air within the cover, the number of orifices present on the cover and their size can vary. In practice, the cover can comprise 2 to 10 orifices, and their size can range from 0.5 mm to 10 mm in diameter, independently for each orifice.

The dispensing member of the assembly according to the invention can advantageously be an application member having an outer application surface. This application member makes it possible to apply the dispensed product directly to the surface to be treated.

Advantageously, the application member can be produced from a rigid or deformable material. For example, the application member can be an open-cell foam, a sponge or preferably a sintered material.

The dispensing member can also include a spray member and, in particular, a push-button provided with a spray nozzle.

Moreover, the container of the assembly according to the invention can be a pressurized container equipped with a product-dispensing valve provided with a hollow valve stem comprising a product inlet and outlet. However, the container could be a manually actuated bottle or flexible tube. In this case, the dispensing member can be fastened directly on the hollow valve stem. According to another alternative, the dispensing member can be carried by a support, the support being fastened on the hollow valve stem. The hollow stem and/or the support make(s) a mechanical connection between the dispensing member and the container.

The dispensing assembly according to the invention is perfectly suitable for the dispensing of a body deodorant. The present invention, therefore, also provides for a body deodorant including a dispensing assembly, as defined above.

The present invention therefore provide for an assembly for dispensing a product which comprises a container containing a product to be dispensed; a product-dispensing member in communication with the container; and a cover which is equipped with a cap that covers the dispensing member and which is fastened on the container. The cover comprises at least two orifices. The cover also comprises a collar fitted on the container which ensures that the cap is held on the container. At least one of the orifices of the cover is arranged in the collar, and the at least two orifices are designed to generate a circulation of air in an internal volume of the cover.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
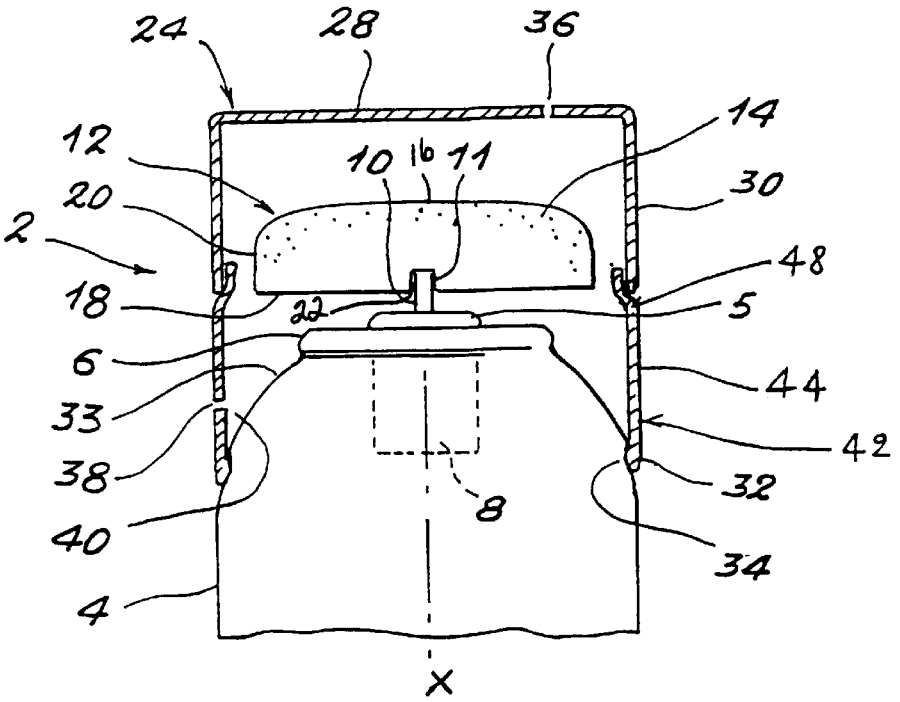
FIG. 1 is an axial section through an application assembly according to a first alternative of the invention.

Referring, now to the drawings, wherein like reference numerals designate identical or corresponding parts throughout the several views, FIG. 1 shows an application assembly, designated as a whole by the reference numeral 2, which has an axis of symmetry X and which comprises a generally cylindrical container 4 pressurized by means of a propellent gas. The container 4 carries, at its upper end, a plate 5 of a valve 8, the plate 5 being fastened to the container 4 by means of a crimping bead 6. The valve plate 5 carries, along the axis X, the dispensing valve 8 which in the present example is a male valve comprising an emergent hollow stem 10. The valve 8 is a lateral-deformation valve, also called a tilt valve, the opening of which takes place as a result of the lateral tilting of the stem 10, or it may be an axial-penetration valve. Moreover, the container 4 contains a liquid product to be dispensed, for example a cosmetic product.

The application assembly 2 comprises, in addition, an application member 12 which comprises a porous dome 14 made of sintered material and equipped with a slightly crowned, outwardly convex upper surface 16. The dome 14 also comprises a plane lower surface 18 perpendicular to the axis X and a lateral surface 20 rotationally cylindrical about the axis X. The lower surface 18 comprises at its center, along the axis X, a bore 22 allowing the forcible insertion of the free end 11 of the hollow valve stem 10.

The application assembly 2 also comprises a cap 24 and a collar 42 performing the function of a cover. The cap 24 comprises an upper surface 28 and a lateral surface 30 rotationally cylindrical about the axis X. The collar 42 comprises a skirt 44 rotationally cylindrical about the axis X and fastened to the container 4 by means of an annular ring 32 located at the lower and of the skirt 44. The annular ring 32 cooperates with an annular groove 34 located in the outer wall of the container 4 at the boundary of a crowned upper part 33 of the container 4. The upper end of the skirt 44 has an annular shoulder 48, onto which a lower end of the lateral surface 30 of the cap 24 is snapped. This arrangement ensures that the cap 24 is held on the collar 42.

The cap 24 and the collar 42, which are thus fastened, cover the application member 12. The upper surface 28 of the cap 24 comprises an orifice 36, and the cylindrical skirt 44 of the collar 42 is equipped with an orifice 38 the size of which can, for example, be 2 mm in diameter. By virtue of their arrangement, these orifices 36, 38 ensure a circulation of air in the internal volume of the cover.

In order to use the application assembly of the invention, the user removes the cap 24 from the collar 42 and then exerts pressure on or bears on the upper surface 16 of the porous dome 14. The application member 12 tilts or penetrates (depending on the type of valve) and causes the valve 8 to open as a result of the tilting or penetration of the stem 10 of the valve 8. The product then diffuses into the porous dome 14 and spreads over its upper surface 16.

If the user actuates the application member 12 for too long, an excess quantity of product emerges from the valve stem 10, and the porous dome 14 is saturated with product. Some product then flows off along the lateral surface 20 of the porous dome 14 and then along the container 4. The product accumulates in a zone 40 located between the container 4 and the lower end of the cylindrical skirt 44 of the collar 42 (in the region of the ring 32).

By virtue of the two orifices 36, 38, air circulation occurs in the cover, assisting the evaporation of the accumulated product in the zone 40 and drying the latter very quickly. Thus, during subsequent use, no product will flow off from the collar 42 and no dirt will soil the container.

The device of the invention therefore makes it possible to keep such an application assembly clean, despite the fact that some product may run out between two successive use operations.

Figure 2:
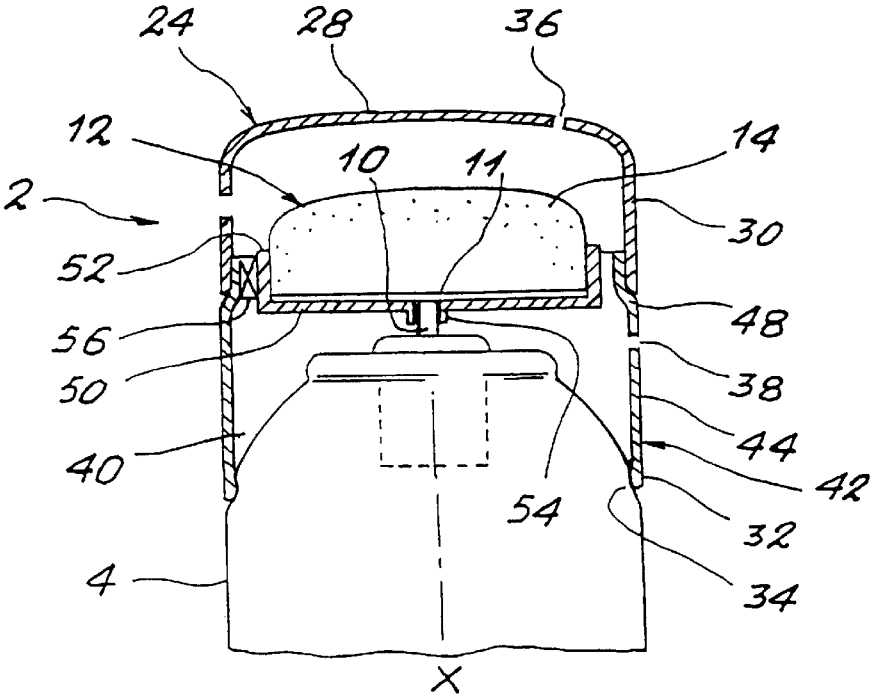
FIG. 2 is a section, similar to that of FIG. 1, through an application assembly according to a second alternative of the invention.

In FIG. 2, those elements which are identical to, or which perform functions similar to, those of elements already described are designated by the same reference numerals. Their description will not be repeated or will be made only briefly.

FIG. 2 shows an application assembly which differs from that of FIG. 1 in that the application member 12 is held forcibly in a support 50 equipped with a peripheral skirt 52 and with a connector 54. The free end 11 of the valve stem 10 is force-fitted in the connector 54. The support 50 is connected by means of its peripheral skirt 52 to the cylindrical skirt 44 of the collar 42 by means of flexible tabs 56. This connection allows flexible actuation of the application member 12 and affords the user a feeling of comfort. This arrangement can, of course, be used in the application assembly of FIG. 1.

The orifice 38 could, of course, have been provided at the upper end of the lateral surface 30 of the cap or of the skirt 44 of the collar 42. Moreover, a third or even a fourth hole could have been made on the surface 28 of the cap, and/or on the surface 30 and skirt 44 respectively.

A push-button equipped with a spray nozzle, as described in FR-A-2 718 720, could be considered instead of the application member of the porous dome type.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the Unites States is:

1. An assembly for dispensing a liquid product, the assembly comprising:

a pressurized container equipped with a product dispensing valve, said container containing a liquid cosmetic product to be dispensed;

a product-dispensing member mounted on said valve so as to be selectively in communication with the container; and a cover which is equipped with a cap that covers the dispensing member and which is fastened on the container, the cover comprising at least two orifices which open to the atmosphere;

wherein:

the cover comprises a collar fitted on the container configured to hold the cap on the container;

said dispensing member is connected to said collar by connection means which allow excess liquid product flowing from set dispensing member to collect between the collar and the container;

at least one of said orifices of the cover is arranged in the collar; and the at least two orifices are positioned to generate a circulation of air in an internal volume of the cover when said cap is fastened on said container, in order to evaporate the collected liquid product.

2. An assembly according to claim 1, wherein said at least two orifices are arranged at different heights along an axis of symmetry of the dispensing assembly.

3. An assembly according to claim 1, wherein another of said at least two orifices is arranged in a wall of the cap.

4. An assembly according to claim 1, wherein an upper surface of the cap comprises another of said at least two orifices.

5. An assembly according to claim 1, wherein said cover includes at least three orifices which open to the atmosphere and wherein the cap comprises an upper surface and a lateral surface, each of the upper surface and the lateral surface comprising at least one of said at least three orifices.

6. An assembly according to claim 1, wherein the dispensing member is fastened directly on the hollow valve stem.

7. An assembly according to claim 6, wherein said connection means is formed only by the hollow valve stem.

8. An assembly according to claim 1, wherein the dispensing member is an application member having an outer application surface.

9. An assembly according to claim 8, wherein the application member is a sintered material.

10. An assembly according to claim 1, wherein the assembly dispenses a body deodorant.

* * * * *